United States Patent [19]

Jepsen

[11] 4,375,861

[45] Mar. 8, 1983

[54] OPENING MEANS FOR A CONTAINER

[75] Inventor: Holger L. Jepsen, Odense, Denmark

[73] Assignee: Haustrups Fabriker A/S, Odense, Denmark

[21] Appl. No.: 187,451

[22] Filed: Sep. 15, 1980

[30] Foreign Application Priority Data

Oct. 3, 1979 [DK] Denmark ..... 4148/79
Oct. 3, 1979 [DK] Denmark ..... 4149/79

[51] Int. Cl.[3] ..... B65D 17/36
[52] U.S. Cl. ..... 220/274; 220/277
[58] Field of Search ..... 220/274, 275, 277, 265–273

[56] References Cited

U.S. PATENT DOCUMENTS 2,455,779 12/1948 Keogh ..... 220/274
2,495,715 1/1950 Geertsen ..... 220/274

FOREIGN PATENT DOCUMENTS 22406 8/1917 Denmark .

*Primary Examiner*—George T. Hall
*Attorney, Agent, or Firm*—Abelman, Frayne & Rezac

[57] ABSTRACT

In a can there are provided a number of weakening lines (1) in the body, the lid or the bottom, said weakening lines defining an opening section (2) intended for being rolled up or drawn away. In the opening section (2) there is arranged a perforating panel (3) being partly surrounded by three, rectilinear weakening lines at a distance from a weakening line (5 or 6) dependent on the form of the opening tool (4), said perforating panel (3) being arranged to be pressed into the interior of the can at the beginning of the opening operation. The panel is depressed by a beak (7) of the opening tool (4), whereby an admission aperture is formed permitting the insertion of a lobe (8) provided with an active point (14) at the end of the tool (4) pointing away from the beak (7). From the interior of the can the point (14) is pressed upwards through an initiating weakening (5), and the opening tool (4) is then rolled across the opening section (2) while rolling it up in the usual manner. The beak (7) is guided by a cavity (10) in the panel (3), whereby there is formed a well-defined, sharp-edged admission aperture for the lobe (8). Thereby the tool (4) is guided safely during perforation of the initiating weakening (5) and during rolling up of the opening section (2).

9 Claims, 10 Drawing Figures

OPENING MEANS FOR A CONTAINER

Figure 1:
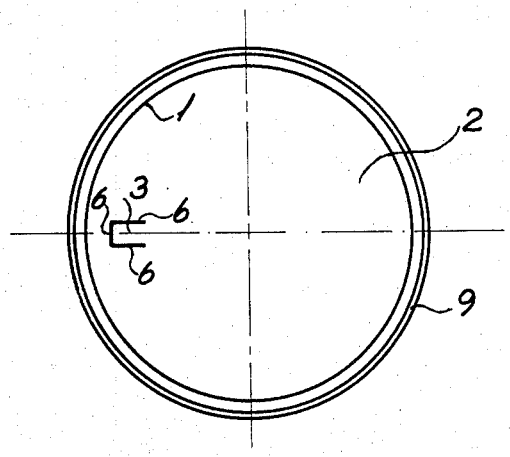

The present invention relates to a hermetically closed or closable container, especially a can of tinplate, aluminium or other metal, and more particularly a container with one or more weakening lines formed in the container material, said lines defining wholly or partly an opening section intended to be rolled up or drawn away, said opening section containing a weakened area in the form of a panel which is arranged for perforation by the action of an opening tool and positioned at a predetermined distance from a weakening line in the opening section or a weakening line around same, said distance being dependent on the form of the opening tool.

It is known to provide in the container material a weakened area intended for perforation and positioned outside the opening section of the container. At the perforation an aperture is produced, which is arranged for the insertion of a fork in a roll-up can-opener around part of the opening section and thus serves as a kind of roll-up tongue. During the perforation the weakened area outside the opening section will be moved inwards into the container, and consequently the opening section will be more accessible through the aperture produced at the weakened area, but a circumstantial instruction and some practice will be required to guide the fork in the opener in over the opening section. This known opening system has been described in Danish Patent Specification No. 57,059.

Danish Patent Specification No. 22,406 describes a hermetically closed can in which the area to be perforated is positioned in the opening section and is defined by a U-shaped weakening line, of which the bottom line of the U faces the weakening line of the opening section. This can is opened by a flat key having an incision arranged to be placed over the lid seam and two tips, one of which forces the perforation area downwards into the can, while the other tip penetrates the lid in the very weakening line forming a depressed point. After this a flat lobe projecting from the shaft of the key is inserted between the two tongues, and the lid is rolled up by rotating the key about its longitudinal axis. The simultaneous perforating at two places is difficult or impossible to carry out with some accuracy, and the depressed portions do not form a well-defined abutment for the guidance of the key while rolling the opening section up. Hence it is hardly possible to ensure an easy and uniform opening of this can, which as far as I know has never been put into practice. The flat lobe of the key thrusts upwards against the tongue depressed from the weakening line and will tend to slip or tip thereon, and since the shaft of the key is not steadily guided, the key may easily get into such slanting position that the weakening line of the two sides of the perforation will be subjected to unequal pressures, and thus unsymmetrical influence of pressure will make it difficult to open the can and produce a regular opening.

The invention has for its object to indicate a container and a matching opening tool ensuring such guidance of the tool that a quick, easy and uniform opening of the can is obtained.

According to the invention this object is achieved by the perforation panel being substantially rectangular and defined by a midpost rectilinear weakening line and two adjoining substantially rectilinear weakening lines, and that the perforation panel is provided with an indication, preferably a shaped marking produced by stamping or embossing for guidance of a perforation beak on the opening tool at the beginning of the opening operation.

The tool for use when opening the container comprises a shank portion and a main portion, the main portion being positioned at one end of the shank portion and provided with an incision arranged to abut against a lid seam and with a beak arranged to perforate the perforation panel, and a lobe being positioned at the shank end pointing away from the main portion, said lobe being integral with the shank and arranged for insertion through the admission aperture, formed by the perforation, and according to the invention, said lobe is provided with an active point for penetrating the remaining material of the weakening line from within the container, the lobe being so curved that the active point projects upwards towards the inner side of the container material during the insertion of the lobe through the aperture of admission at the perforation panel.

As the perforation panel is defined by the said weakening lines and has a stamped, e.g. spherical cavity ensuring correct positioning of the perforating beak of the opening tool, a well-defined sharp-edged opening is provided when penetrating the panel, said opening having a midmost rectilinear abutment edge which ensures exact positioning of the lobe of the tool under the weakening line of the opening section for an initial penetration hereof. Further said midmost, straight line together with the two substantially straight adjoining edges provides for a secure guidance of the tool rotating about its longitudinal axis during rolling up of the opening section, whereby is obtained an equal influence upon the weakening line at both sides of the initial perforation and hence a convenient and regular opening of the container. The curved point of the lobe of the tool can be brought in position in a pure translatory movement of the tool in an inclined direction downwardly towards the opening section, preferably guided by the partly depressed perforation panel which forms a slanting guide surface.

The penetration of a small area of a weakening line by pressing from within the container a pointed part of the opening tool upwards against the said small area requires only a relatively slight application of force to the opening tool, as the tool will turn about an axis in the opening tool while forming a moment arm out to the point of the tool. By this arrangement the remaining material of the weakening lines may be relatively thick, which is obviously advantageous, seeing that in regard to strength the container is not unnecessarily weakened.

An embodiment of the inventive container, in which the opening section is formed in the lid or the bottom is characterized in that the opening section is defined by at least one weakening line, extending along a substantial part of the peripherical direction of the lid or the bottom, respectively. Hereby is obtained a relatively big admission aperture.

In a further embodiment of a container according to the invention the opening section is a ribbon extending preferably concentrically in the lid of the bottom, in which said ribbon there is formed an initiating weakening extending from the outer to the inner weakening line transversely of the ribbon, said initiating weakening being arranged to cooperate with the perforation panel at the opening operation and positioned at the said predetermined distance from same. The uprolling of the opening section in the longitudinal direction of the ribbon-like opening section can thus be effected immediately after the penetration, and a relatively small force is needed.

In a preferred embodiment of a container according to the invention the opening section is a ribbon extending in the peripherical direction of the container body, in which said ribbon there is formed an initiating weakening extending from one weakening line across the ribbon to the other weakening line, said initiating weakening being arranged to cooperate with the perforation panel at the opening operation and positioned at the said predetermined distance from same. The position of the opening section in the container body is advantageous for containers holding e.g. blocks of meat, as the block can be taken out without hindrance, e.g. from the container lid which is removed wholly or partly at the opening.

According to the invention the transverse initiating weakening may extend through the weakening lines, which define the opening section, and a small distance into the container material at both sides of the ribbon. By this arrangement the initial unrolling is facilitated, as it is certain that the initiating weakening extends all the way to the longitudinal, ribbon-defining weakening lines. For this reason the equipment for producing the transverse initiating weakening does not have to be produced and positioned with such precision as is necessary, if the initiating weakening must be terminated exactly in the weakening lines at either side of the ribbon.

A transverse initiating weakening extending along a sine-like curve over half a period thereof, the starting point (0°) and the ending point (180°) being situated substantially in the points of intersection with the ribbon-defining weakening lines, has proved to produce an excellent unrolling, especially in the critical first phase of the unrolling. However, the transverse initiating weakening may naturally also extend along a plurality of other forms of curves, e.g. along a parabola or a semicircle.

The remaining material at the weakening lines may have a thickness substantially of 100 to 140$\mu$, whereas in the hitherto known containers, for which no opening tools are used, it is necessary to let the remaining material have a thickness substantially of only 70$\mu$ to obtain a convenient drawing away of the opening section of a tinplate lid.

In a container formed according to the invention the midmost weakening line of the perforation panel is arranged in such manner that the active point of an opening tool which is advanced through the perforation panel into the interior of the can is guided by the effect of the said edge of the perforation panel into a position immediately below the initiating weakening or the weakening line around the opening section serving as initiating weakening.

The lobe can be guided in a simple and reliable way, as a contact face on the opening tool can be arranged to abut against the midmost edge of the perforation panel and thus prevent a further advance of the tool, when the active point is in the desired position below the initiating weakening. Moreover the perforation edges and the depressed perforation panel may serve as a guiding face at the introduction of the tool; when starting rolling up of the opening section the two parallel edges will cooperate in preventing displacement of the tool in the longitudinal direction, whereby uniform pulling of the material at both sides of the perforation panel is ensured.

According to the invention the perforation panel may be positioned at a predetermined distance from the lid seam or bottom seam of the container, said distance being dependent on the form of the opening tool. By this arrangement correct depression of the panel by the tool is ensured in a simple manner.

In a preferred embodiment of the tool according to the invention the lobe protrudes from the shank at the lateral edge thereof which is placed opposite the incision and the beak. By placing the lobe at this very side of the key shank, the operator's fingers may grip the shank along the whole of its extent, when the incision is placed over the lid seam, as the lobe protrudes inwards toward the palm of the hand at this position of the tool.

According to the invention the curved lobe may be bent substantially together so as to form a small slit which is slightly larger than the thickness of the container material. In this embodiment the shank portion is moved at a smaller distance above the opening section, and thus it is not brought into contact with parts of the edge of the perforation panel that may have been bent up askew during the advancing of the lobe towards the initiating weakening. Moreover, with a lobe curved in this way there is obtained increased certainty that the opening section is unrolled substantially circular-cylindrically at a continued turning of the key, which causes an evenly progressing unrolling without "moment points", as will be the case e.g. by an oval unrolling.

According to the invention the shank portion around the lobe may have a constant cross section, at least over a part thereof which extends as far as to the edge of the lid, when the lobe is placed in the aperture of admission. By this means it is made even more certain that the unrolling will progress evenly throughout the longitudinal extent of the opening section and result in a cross-sectionally substantially circular-cylindrical rolled-up mat.

However, according to the invention the shank portion around the lobe may also be conically tapered from the free end towards the lid seam, when the lobe is placed in the aperture of admission. This embodiment is suitable for use when opening containers of the kind in which the opening section is a ribbon extending in the lid or the bottom, seeing that in this case a rolled-up mat with a conically tapered shape is produced.

Figure 2:
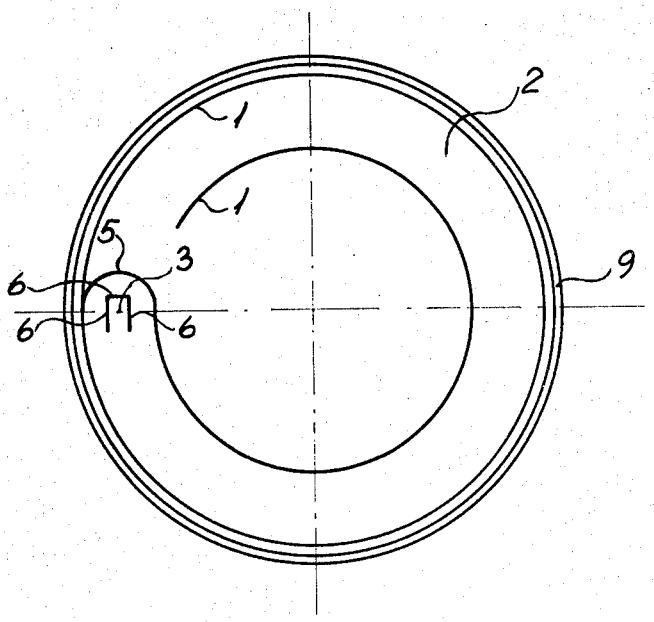
Figure 3:
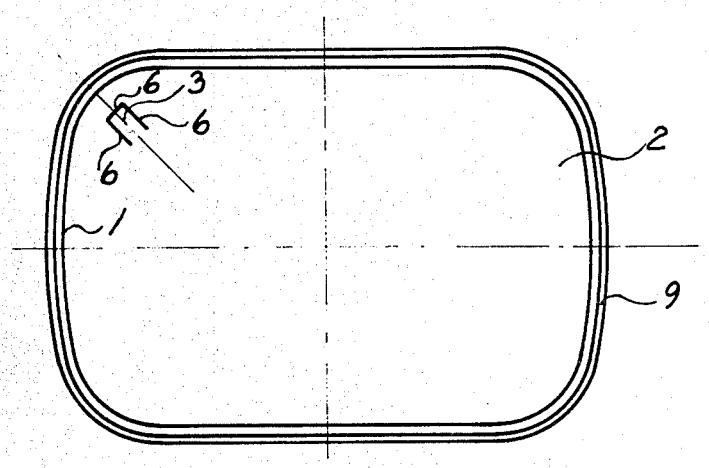
Figure 4:
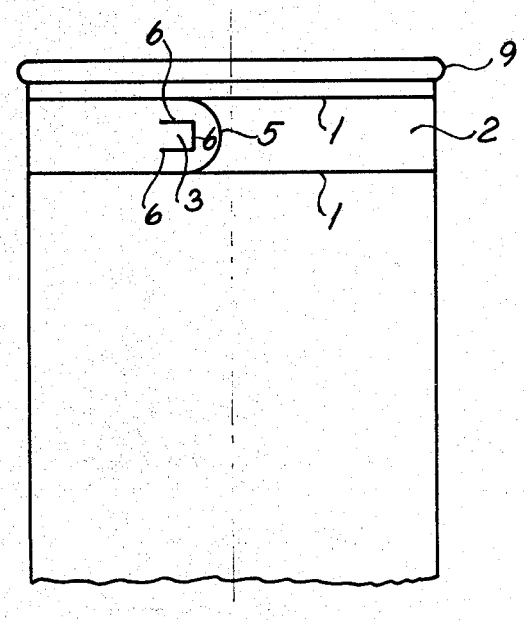
Figure 5:
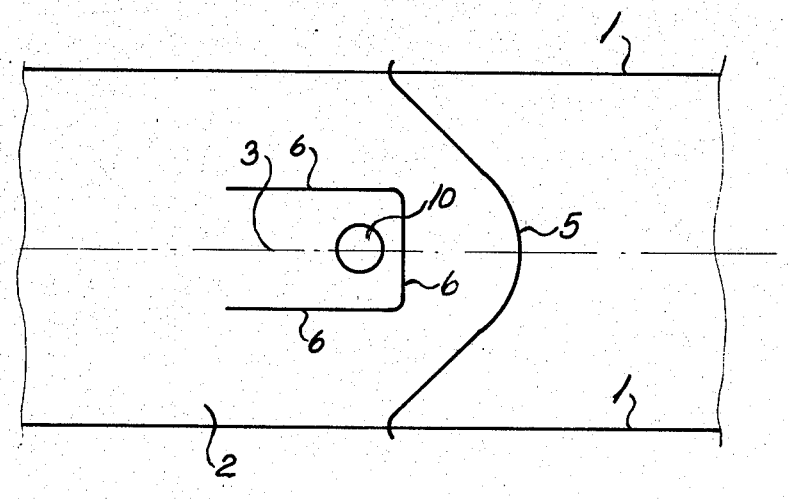
Figure 6:
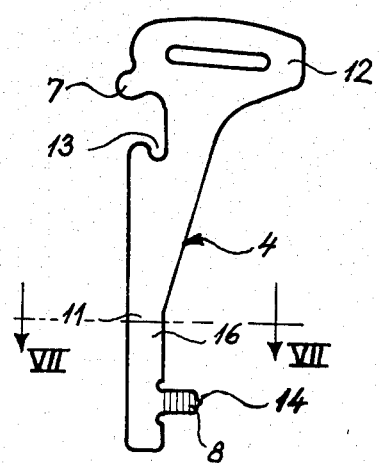
Figure 7:
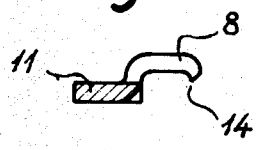
Figure 8:
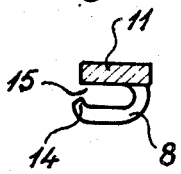
Figure 9:
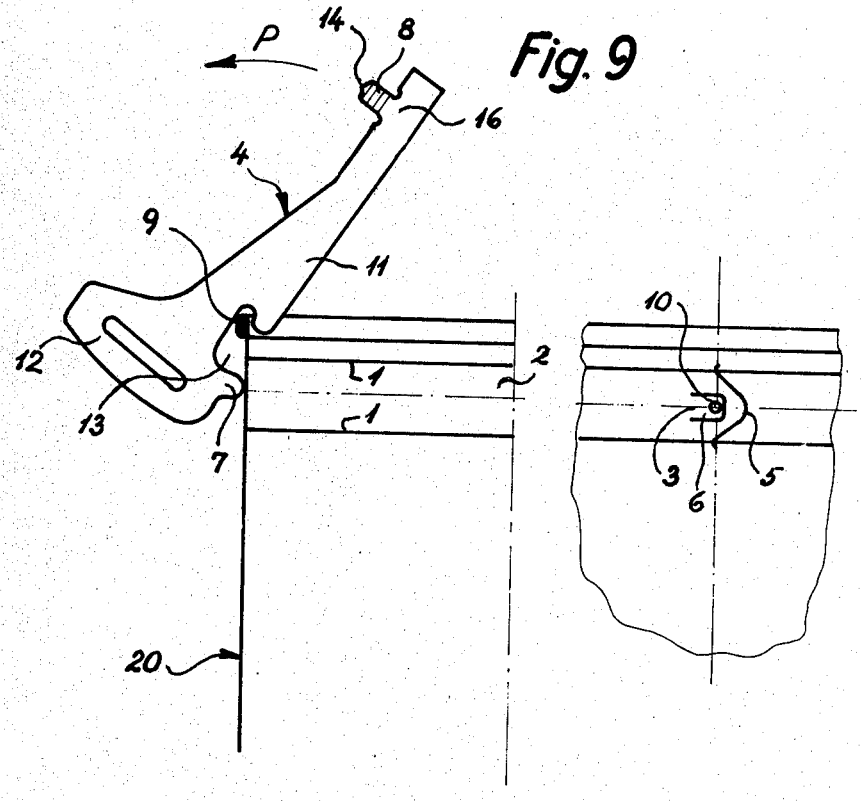
Figure 10:
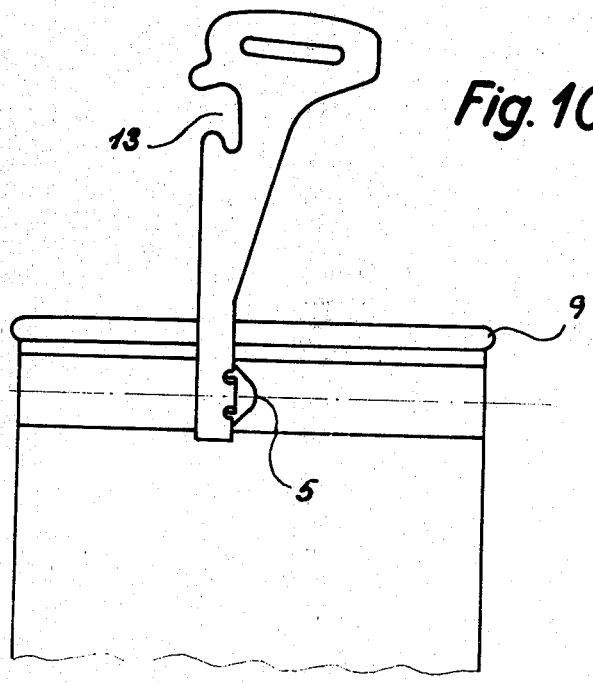

The invention will now be explained in more detail, reference being had to the drawing, wherein:

FIG. 1 is a top view of a can lid for a container according to the invention, FIG. 2 is an illustration corresponding to FIG. 1, but showing another embodiment, FIG. 3 shows still another embodiment of a lid for a container according to the invention, FIG. 4 is a side view of a container formed in accordance with the invention, wherein the opening section is positioned in the container body, FIG. 5 shows on an enlarged scale a detail view of a transverse initiating weakening, FIG. 6 is a suitable opening tool for use at the opening of a container according to the invention, FIG. 7 is a section on the line VII—VII in FIG. 6 on an enlarged scale, FIG. 8 is an illustration corresponding to FIG. 7, but showing a modified form of the lobe extending from the shank, and FIGS. 9 and 10 show an example of the use of an opening tool according to the invention.

FIG. 1 of the drawing shows the lid of a can as seen from above. At its edge region the can lid is attached in a manner known per se to the can body by means of a lid seam 9. A circular weakening line 1 encompasses a central opening section 2. By means of three weakening lines 6 extending at right angles to each other there is defined in the opening section a perforation panel 3, which is arranged for depression into the interior of the can while forming an aperture of admission for an opening tool 4 (FIG. 6). When the opening tool 4 has been placed in a predetermined position with a hook or lobe 8 protruding into the can, the lobe which has an active point can be tilted upwards to penetrate the weakening line 1 from within the can and to roll up the opening section 2 in a manner known per se.

In the embodiment shown in FIG. 2 the active point of the opening tool 8 is made to engage the transverse initiating weakening 5, and by continued application of force to the opening tool 4 the initiating weakening 5 is penetrated, whereupon the opening section 2 can be wound up in its peripherical direction.

The embodiment shown in FIG. 3 corresponds substantially to the embodiment according to FIG. 1, but in the embodiment according to FIG. 3 the opening section 2 is substantially rectangular, and the perforation panel 3 is situated close to a corner.

In FIG. 4 the opening section 2 is positioned in the container body and formed as an annular ribbon. The ribbon is broken by a transverse initiating weakening 5 and provided with the perforation panel 3, defined along three of its sides by weakening lines 6, which panel is characteristic for the invention.

FIG. 5 illustrates a preferred embodiment. As appears from this figure the transverse initiating weakening 5 extends beyond the ribbon-defining weakening lines 1 at both sides of the ribbon. FIG. 5 also shows the characteristic sine-like course of the initiating weakening 5 across the ribbon or opening section 2.

The key 4 shown in FIG. 6 consists of a shank 11, a head 12 formed at one end thereof, and a beak 7 arranged for use at the depression of the weakened area. The head 12 of the key is formed in a manner known per se and provided with an incision 13 which has a shape that is complementary to a conventional lid seam or bottom seam 9 and arranged to abut against such a seam or ridge, when the beak 7 protruding from the head is to be forced through the perforation panel 3 and press this area into the container by breaking the surrounding weakening lines. As appears from FIGS. 6–8 the lobe 8 is provided with a pointed projection 14 at its free end.

The section on the line VII—VII shown in FIG. 7 illustrates the preferred embodiment, wherein the lobe is curved and provided with an upwardly projecting active point 14 which is arranged to penetrate the remaining material of the weakening line by a turning of the key in the uprolling direction of the opening section, when the lobe is in the desired position in the interior of the container.

FIG. 8 shows another embodiment, wherein the lobe 8 is curved backwards and inwards toward the shank 11.

The operation of the shown key is most clearly illustrated in FIGS. 9 and 10. In the container 20 shown in FIG. 9 the opening section 2 is formed as a ribbon extending in the peripherical direction of the container body. When the incision 13 at the head 12 of the key has been placed over the lid seam 9 the key is turned by fingers about the centre of rotation at the lid seam 9 and in the direction of the arrow P (FIG. 9). The turning is most expediently carried out by placing two or three fingers on the lateral edge of the key shank pointing away from the lobe 8 and a thumb on the lateral edge of the head 12 opposite the perforation beak 7, which said edge may have a curved or straight abutment face, suitably arranged to receive the thumb. When the incision 13 is placed over the lid seam 9 it is simultaneously ensured that the perforation beak 7 is placed over the very part of the perforation panel 3, from which the depression is to be initiated. The perforation panel has a shaped marking 10 guiding the beak 7.

When the perforation panel has been pressed into the container wholly or partly, an aperture for the admission of the lobe 8 at the opposite end of the key has been formed. By grasping the head 12 of the key, the lobe may easily be guided inwards through the aperture and forward to a position, wherein the key shank 11 at the lobe 8 abuts against the edge of the aperture, and the active point 14 is pressing exactly against the under side of the initiating weakening 5 (FIG. 10). By a turning of the key in the uprolling direction of the opening section and with the key shank 11 resting on the lid seam 9, the remaining material of the initiating weakening 5 is penetrated, and the upper side of the lobe 8 is brought into abutment against the under side of the opening section 2 in the area between the edge of the aperture and the initially broken weakening line section. By continued turning of the key, which is effected by turning the key head 12 with the fingers, the first part of the opening section is swung upwards and thereupon downwards toward the upper side of the adjoining opening section 2 while forming a cross-sectionally substantially circular-cylindrical rolled-up mat. The uprolling can now be continued along the opening section 2 in a quite well-known manner. The lobe 8 ensures a circular-cylindrical shape of the rolled-up material immediately from the start of the unrolling.

The invention is not restricted exclusively to the features shown and described herein, and it is especially to be noted that a container arranged in conformity with the invention can be opened with tools or can-openers which are widely different from the opening tool which has been shown in FIG. 6.

It should also be noted that the idea on which the invention is based can be applied to containers of any kind and thus also to container bodies which are formed by drawing or provided with a soldered or welded longitudinal seam.

I claim:

1. A tabless hermetically sealable container having a first score line defining a tear-out member in a wall of the container, and a second score line defining a rupturable perforation panel in said tear-out member having an end edge spaced from said first score line and side edges extending away from said first score line, said perforation panel providing an aperture for the insertion of an opener member into the container upon displacement of the perforation panel into the container;

wherein said end edge is rectilinear, and said end edge and said side edges provide corresponding edges on said tear-out member constituting reference abutments for said member to be employed in opening the container.

2. The container of claim 1, in which said perforation panel includes a reference depression extending inwardly of the container wall.

3. The container of claim 1, in which said tear-out member is a panel in one of the walls of the container, and said first score line is a continuous line extending around said panel.

4. The container of claim 1, in which the tear-out member is a strip extending circumferentially of one of the walls of the container, and said first score line is a continuous line which defines one end and the lateral side edges of the strip.

5. The container of claim 1, in which said tear-out member is defined by spaced score lines and a transverse score line which intersects and extends beyond each of said parallel score lines.

6. The tabless hermetically sealable container of claim 1 in combination with an opener member having a laterally offset hooked lobe terminating in a pointed projection for engagement with that face of said tear-out member which is presented inwardly of the container, said hooked lobe being receivable within said aperture and positioned by said abutment edges for said pointed projection to engage said inner face of said tear-out member at a position immediately adjacent said first score line and on that side thereof adjacent said aperture.

7. The container and opener member combination of claim 6, in which said opener member further includes a positioning member and a beak spaced therefrom for use in displacing said perforation panel into the container.

8. The container and opener member combination of claim 6, in which said opener member includes an elongate planar body portion and said laterally hooked lobe is integral with said body portion and extends substantially parallel to the plane of said planar body portion.

9. The container and opener member combination of claim 6, in which said opener member includes an elongate planar body portion and said hooked lobe is an integral lateral extension thereof which has been bent for it to overlie the body portion in spaced substantially parallel relationship therewith.

* * * * *